US009353554B2

(12) United States Patent
Carlson

(10) Patent No.: US 9,353,554 B2
(45) Date of Patent: May 31, 2016

(54) EMERGENCY ACCESS MECHANISM FOR A CASH DRAWER

(71) Applicant: APG Cash Drawer, LLC, Minneapolis, MN (US)

(72) Inventor: Ryan Carlson, Shoreview, MN (US)

(73) Assignee: APG Cash Drawer, LLC, Minneapolis, MN (US)

( * ) Notice: Subject to any disclaimer, the term of this patent is extended or adjusted under 35 U.S.C. 154(b) by 0 days.

(21) Appl. No.: 14/693,657

(22) Filed: Apr. 22, 2015

(65) Prior Publication Data

US 2015/0345182 A1 Dec. 3, 2015

Related U.S. Application Data

(60) Provisional application No. 62/005,231, filed on May 30, 2014.

(51) Int. Cl.

| | |
|---|---|
| ***E05B 65/46*** | (2006.01) |
| ***E05B 39/02*** | (2006.01) |
| ***E05B 63/00*** | (2006.01) |

(52) U.S. Cl.

CPC ..... *E05B 65/461* (2013.01); *E05B 39/02* (2013.01); *E05B 63/0069* (2013.01); *Y10T 70/5128* (2015.04); *Y10T 70/5137* (2015.04); *Y10T 70/5142* (2015.04); *Y10T 70/625* (2015.04);

(Continued)

(58) Field of Classification Search

CPC ... E05B 39/02; E05B 39/025; E05B 63/0069; E05B 65/461; Y10T 70/7915; Y10T 70/7949; Y10T 70/8216; Y10T 70/8946; Y10T 70/625; Y10T 70/5128; Y10T 70/5137; Y10T 70/5142

USPC ..... 70/50, 1.5, 1.7, 422–424, 427, 428, 70/432, 439, 440, 455, 85–88

See application file for complete search history.

(56) References Cited

U.S. PATENT DOCUMENTS 1,460,472 A * 7/1923 Benson ..... E05B 39/02 70/50
1,659,433 A * 2/1928 Waldemar ..... E05B 39/02 70/423

(Continued)

FOREIGN PATENT DOCUMENTS

| | | | |
|---|---|---|---|
| GB | 2064638 | * | 6/1981 |
| JP | 2007-247390 | A | 9/2007 |
| KR | 20-0205771 | Y1 | 12/2000 |

OTHER PUBLICATIONS

International Search Report and Written Opinion for International Application No. PCT/US2015/031334 date of mailing: Sep. 8, 2015, date of filing: May 18, 2015, 12 pages.

*Primary Examiner* — Lloyd Gall

(74) *Attorney, Agent, or Firm* — Katherine M. Scholz; Kelly, Holt & Christenson, PLLC

(57) ABSTRACT

An emergency access mechanism for a cash drawer is provided. In one embodiment, the emergency access mechanism comprises an emergency access plug configured to engage with a locking mechanism of the cash drawer such that actuation of the emergency access plug causes the locking mechanism to release. The mechanism may also comprise an emergency access cover configured to fit partially over and engage the emergency access shell, such that actuation of the emergency access cover causes a portion of the emergency access cover to break.

20 Claims, 8 Drawing Sheets

(52) U.S. Cl.
CPC ..... *Y10T 70/7915* (2015.04); *Y10T 70/8216* (2015.04); *Y10T 70/8946* (2015.04)

(56) References Cited

U.S. PATENT DOCUMENTS 2,036,747 A * 4/1936 Fitz ..... E05B 19/00 70/377
2,145,314 A * 1/1939 Murtaugh, Jr. ..... E05B 65/461 109/47
2,225,703 A * 12/1940 Machinist ..... E05B 15/1614 70/417
2,307,106 A * 1/1943 Brush ..... E05B 17/185 52/372
2,617,290 A * 11/1952 Schwartz ..... E05B 17/106 250/466.1
3,572,063 A * 3/1971 Foote ..... E05B 39/02 70/423
3,625,035 A * 12/1971 Brummer et al. ..... H01H 9/04 70/365
3,795,123 A * 3/1974 Stiffel ..... E05B 15/02 70/417
4,074,548 A * 2/1978 Milton ..... E05B 17/0062 70/1.5
4,143,531 A * 3/1979 Floyd ..... E05B 17/0012 70/367
4,363,229 A * 12/1982 Baitz ..... E05G 5/006 70/159
4,446,709 A * 5/1984 Steinbach ..... E05B 27/086 70/419
4,676,084 A * 6/1987 Signorelli ..... E05B 39/02 292/307 R
4,685,317 A * 8/1987 DeWalch ..... E05B 39/02 292/307 R
4,735,069 A * 4/1988 Steinbach ..... E05B 19/00 264/248
4,895,008 A * 1/1990 Blake ..... E05B 47/0607 109/47
5,487,287 A * 1/1996 Viggiano ..... E05B 9/08 70/370
5,611,225 A * 3/1997 Resch ..... E05B 17/0062 70/422
5,689,098 A 11/1997 Gillieron
5,829,281 A * 11/1998 Yamashita ..... B62H 5/02 70/183
5,829,284 A * 11/1998 Yamashita ..... B60R 25/02115 70/215
6,880,376 B1 * 4/2005 Ko ..... E05B 29/0013 70/366
7,194,876 B1 * 3/2007 Pacheco ..... E05B 9/04 70/1.5
7,251,970 B2 * 8/2007 Mielonen ..... E05B 9/04 70/366
2006/0022031 A1 2/2006 Chien
2006/0070412 A1 * 4/2006 Wiseman ..... E05B 47/0603 70/88
2008/0231154 A1 9/2008 Rudduck et al.

* cited by examiner

EMERGENCY ACCESS MECHANISM FOR A CASH DRAWER

CROSS-REFERENCE TO RELATED APPLICATION

The present application is based on and claims the benefit of U.S. Provisional Patent Application Ser. No. 62/005,231, filed May 30, 2014, the content of which is hereby incorporated by reference in its entirety.

BACKGROUND

Anyone who has been in a retail store is familiar with the checkout stand; the checkout stand is where one pays for the selected items. Checkout stands, also commonly referred to as check stands, can be arranged in a broad variety of configurations. The checkout stand may include one belt, two belts, three belts, or merely have a stationary surface, generally supported by a counter or cabinet. A barcode scanner is typically recessed into the counter or cabinet. Also included at the checkout stand are the register, cash drawer, a keyboard, a credit card machine (often referred to as a credit card swipe and pin pad machine), a receipt printer, monitor or display, telephone, and other such accessory equipment. A checkout stand may also include equipment for accepting wireless payment information. The register, cash drawer, and other equipment are typically positioned on a cabinet often referred to as a cash stand, which is positioned to the left or right of the cashier, at a right angle to the check lane as the cashier is looking at the customer.

One of the most important features of the checkout stand is the cash drawer. A cash drawer may be a flip-top or a lay-flat cash drawer. A flip-top cash drawer is one where the top of the cash drawer rotates on a pivot such that the lid rotates up and away from a front face of the cash drawer, resulting in the currency within the cash drawer becoming readily accessible. A lay-flat cash drawer, commonly seen in the United States, incorporates sliders such that, when unlocked, the cash drawer physically rolls forward revealing the cash and change inside. Either a flip-top or a lay-flat drawer may incorporate an unlocking mechanism, often requiring a key. One known problem with existing cash drawers is that, in some situations, for example, when the power is out, cash drawers may be difficult to open as a key may not be readily accessible. A cash drawer may include an emergency access hole, such that a tool can be used to open the latch. Additionally, a cover may fit over the lock and be screwed or otherwise fixed in place.

SUMMARY

An emergency access mechanism for a cash drawer is provided. In one embodiment, the emergency access mechanism comprises an emergency access shell configured to engage with a locking mechanism of the cash drawer such that actuation of the emergency access shell causes the locking mechanism to release. The mechanism may also comprise an emergency access cover configured to fit partially over and engage the emergency access shell, such that actuation of the emergency access shell causes a portion of the emergency access cover to break. These and various other features and advantages that characterize the claimed embodiments will become apparent upon reading the following detailed description and upon reviewing the associated drawings.

DETAILED DESCRIPTION OF THE PREFERRED EMBODIMENTS

Figure 1A:
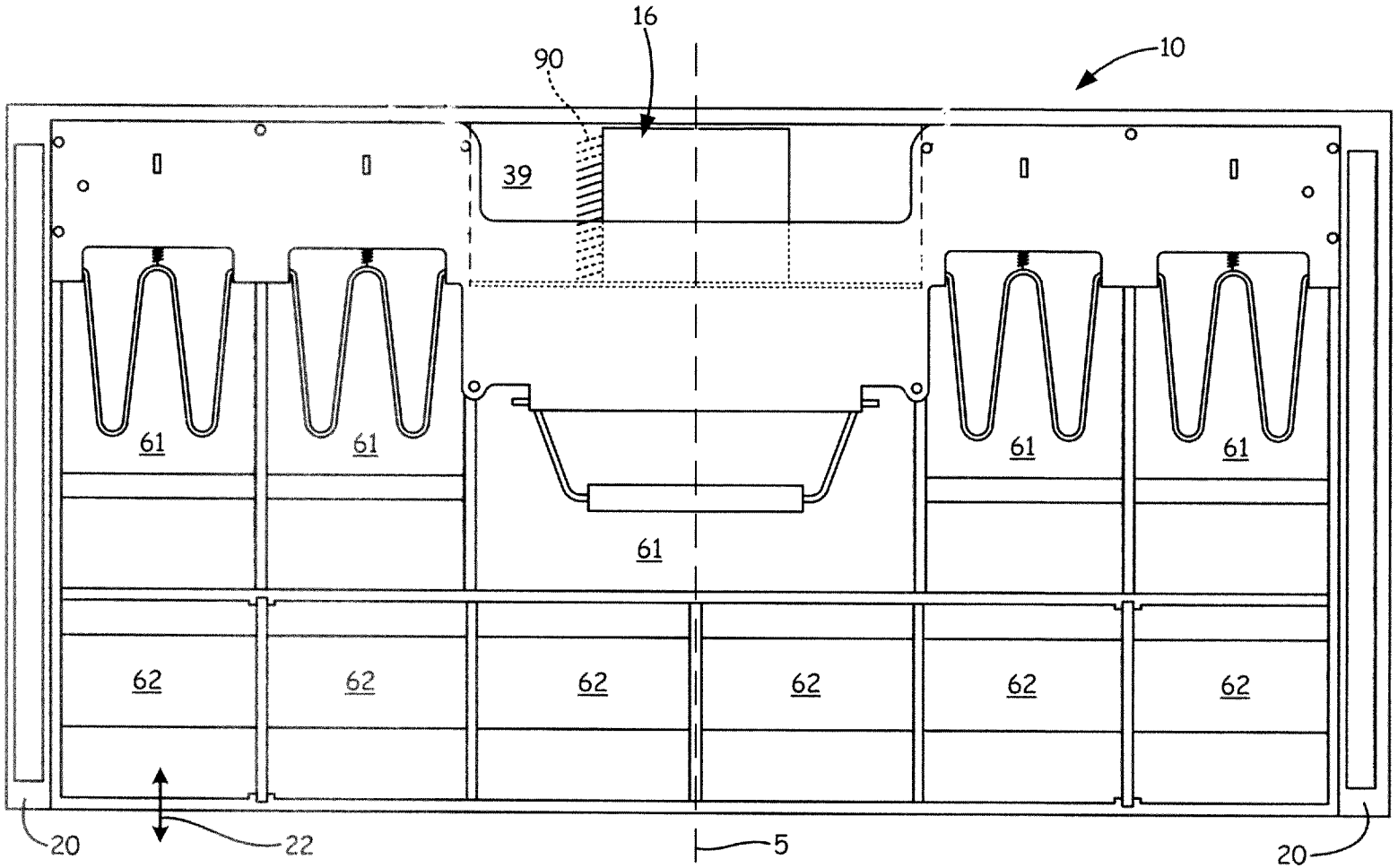
FIG. 1A is a top plan view of an exemplary lay-flat cash drawer till assembly.
Figure 1B:
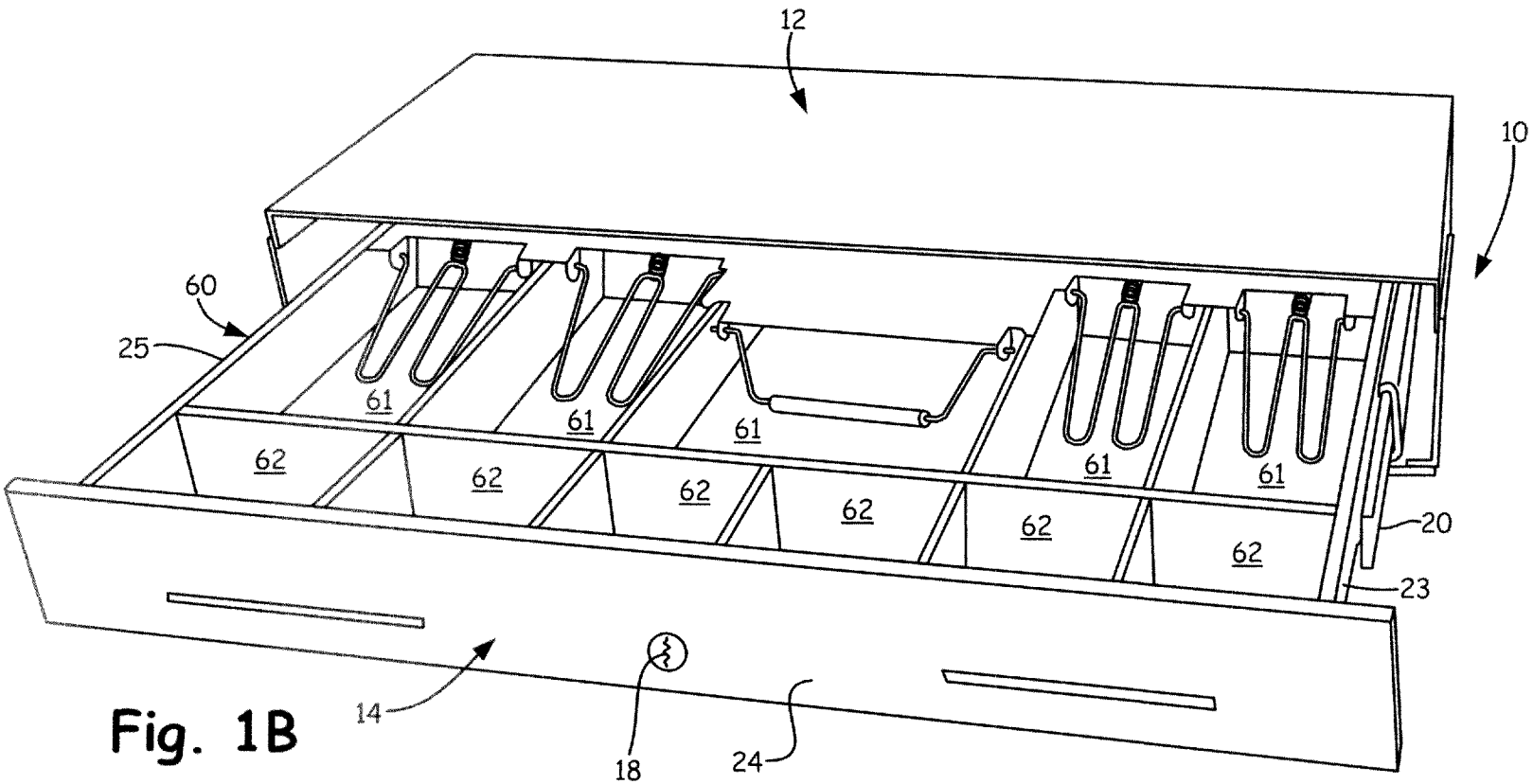
FIG. 1B is a perspective view of an open lay-flat cash drawer in a cash drawer till assembly.
Figure 1C:
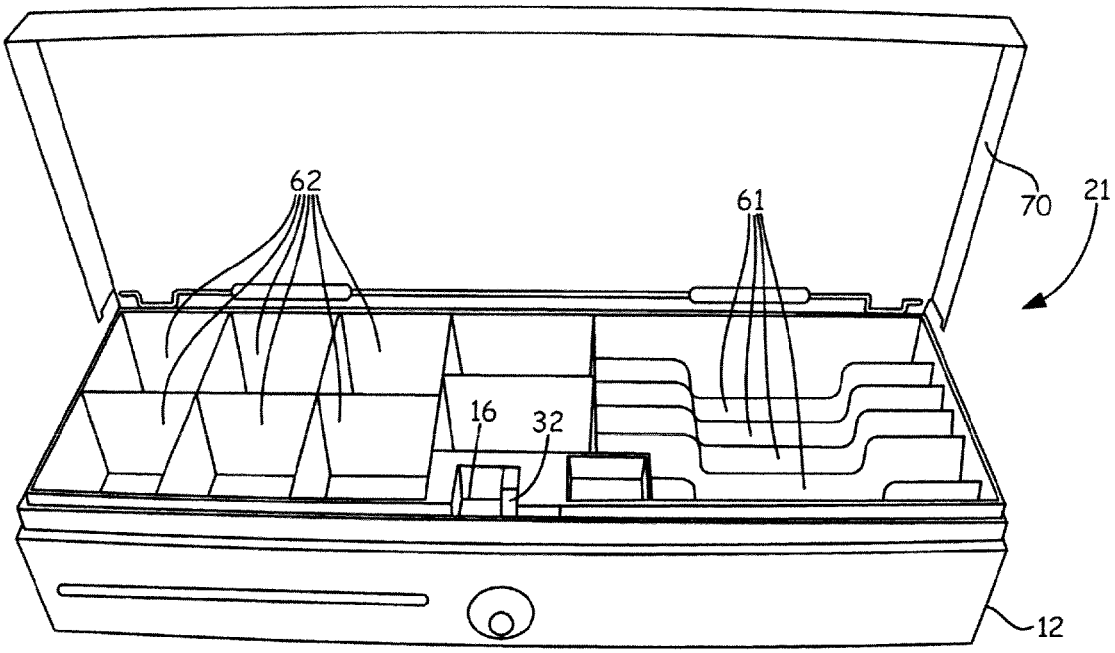
FIG. 1C is a perspective of an open flip-top cash drawer.

FIGS. 1A-C illustrate an exemplary lay-flat cash drawer till 10 and flip top cash drawer 21. FIG. 1A is a top plan view of exemplary lay-flat cash drawer assembly 10. FIG. 1B is a perspective view of an open lay-flat cash drawer till in a cash drawer assembly. FIG. 1C is a perspective of an open flip-top cash drawer.

The housing 12, shown in FIG. 1B, has been removed from the cash drawer of FIG. 1A for clarity in understanding the internal workings of a cash drawer till assembly 10. Cash drawer assembly 10 illustratively includes a housing 12, an inner drawer 14, a latch mechanism 16 and a key locking mechanism 18. Drawer 14 is slidably mounted within housing 12 by a pair of slides 20, mounted on opposite sides of housing 12. Drawer 14 is slidable within housing 12 on slides 20 in the direction indicated by arrow 22. While a pair of slides 20 are illustrated in FIG. 1A, those skilled in the art will recognize that other support arrangements and/or number of slides 20 can also be used. Commonly, a cash drawer or till 60 is inserted into drawer 14. The cash drawer 60 typically has a number of dividers 61 and 62 for storing currency, coupons and other items required in a cash register system. Depending on the country or the specific culture where the cash tray 60 is used, paper currency may be stored in different positions or arrangements. Commonly, paper currency is stored in dividers 61 in a flat position as illustrated in FIG. 1A, and is sorted by value. However, as shown in FIG. 1C, currency may also be stored in an upright position separated by dividers 61 and may be sorted by value. Metal or coin currency is commonly stored in bins 62 and may also sorted by value.

Inner drawer 14, in one embodiment, has a latch mechanism that is configured to keep the cash drawer 10 or cash drawer 21 closed. In one embodiment, latch ejection mechanism 16 (LEM) includes a pivotable rotary latch member 32 (rotary latch 32), and an electrically operated solenoid (not shown). However, other types of latch mechanisms can be used, such as a single stage latch. When in the locked position, the LEM 16 holds drawer 14 in a closed position. LEM 16 thus inhibits the movement of drawer 14. To open drawer 14, the LEM 16 may, in one embodiment, receive an input signal from an external control component (not illustrated) which causes an actuation of the LEM 16. In another embodiment, the LEM is configured to be engaged manually, for example with a key. Upon actuation of the LEM 16, a restraining component disengages and allows drawer 14 to slide forward, out of housing 12. The flip-top drawer 21, shown in FIG. 1C, works in a similar manner wherein upon actuation of the LEM 16 results in the top of the flip-top cash drawer 21 opening.

Cash drawer assembly 10 is conventionally provided with a spring 90 (shown in FIG. 1A), which is coupled to base plate 39 of housing 12, and which biases drawer 14 to an open position upon actuation of the LEM 16. However, any other appropriate spring configuration can be used as well. Further, other opening and biasing elements can be used for opening and holding closed the drawer 14.

It sometimes happens in a retail environment where the external control component which would provide an input signal to the solenoid of the LEM 16 is not functioning. This may happen, for example, in a power outage or in a device failure. In such a situation, it may be necessary for a cashier to access cash drawer assembly 10 or cash drawer assembly 21. Further, the cashier may need to find a supervisor who has a key to open the key locking mechanism 18. However, in an emergency it may be difficult to find a supervisor with the key. In such a situation it would be helpful for both the flip-top cash drawer configuration 21 and the lay-flat cash drawer configuration 10 to be equipped with an emergency access mechanism, for example, the emergency access mechanism shown FIG. 2. What is desired is a cash drawer with a more convenient emergency opening mechanism such that the cash drawer can be opened in an emergency situation without the requirement of a key. Another need is that there should be evidence of the cash drawer having been opened, so as to detect potential thefts.

Figure 2:
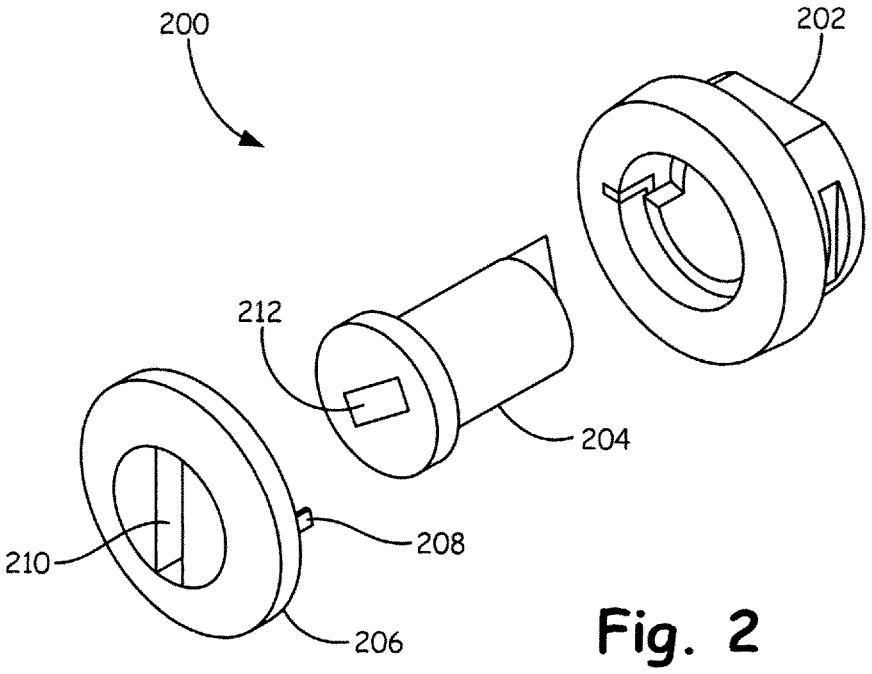
FIG. 2 is an exploded view of an emergency access mechanism for a cash drawer.

FIG. 2 is an exploded view of an emergency access mechanism for a cash drawer. In one embodiment, the emergency access mechanism comprises an emergency access insert 200 that replaces the key-locking mechanism 18 of either the flip-top cash drawer 10 or lay-flat cash drawer 21. In one embodiment, the emergency access mechanism is installed in the cash drawer during manufacture. In another embodiment, the emergency access mechanism is configured to be installed as an after-market feature. The emergency access insert 200 comprises an emergency access shell 202, an emergency access plug 204 and an emergency access cover 206. The emergency access cover 206 also includes, in one embodiment, a plurality of emergency access snaps 208. In one embodiment, the emergency access cover 206 overlays the emergency access plug 204 and both fit into the emergency access shell 202. In another embodiment, the emergency access cover 206 and emergency access plug 204 may be formed of a single unitary piece. While FIG. 2 illustrates the snaps 208 as being part of the emergency access cover 206, in another embodiment the snaps 208 could be part of the emergency access shell 202.

The emergency access mechanism may be configured such that, in an emergency situation, a cashier who needs to access the cash drawer, may do so by inserting a coin or similar flat object into recess 210 of the emergency access cover 206, and rotating it such that emergency access snaps 208 are broken, in one embodiment. Once the emergency access cover 206 is broken, it may fall off in pieces or the cashier can remove it. The cashier then has access to emergency access plug 204 and can see recess 212. The cashier can then insert a coin or similar flat object into recess 212. The cashier can then rotate the emergency access plug 204 which then engages with the latch ejection mechanism 16 and triggers an opening of the cash drawer. In one embodiment, triggering the opening of a cash drawer triggers the drawer of a lay-flat cash drawer assembly 10 to slide forward. In another embodiment, triggering the opening of a flip-top cash drawer 21 results in the top of the cash drawer being opened such that a cashier can access the cash and other currency located inside.

In one embodiment, all of the portions of the emergency access insert are comprised of plastic material. In another embodiment, only the cover 206 is made of plastic material while the plug 204 and the shell 202 are made of metal, for example aluminum. In another embodiment, the cover 206 comprises a deformable plastic, such that the snaps 308 do not break when the cover 206 is rotated, but instead deform such that the cover 206 no longer can engage with the shell. In one embodiment, the emergency access insert is aesthetically designed to look like a key-locking mechanism in order to deter potential theft or tampering.

Figure 3A:
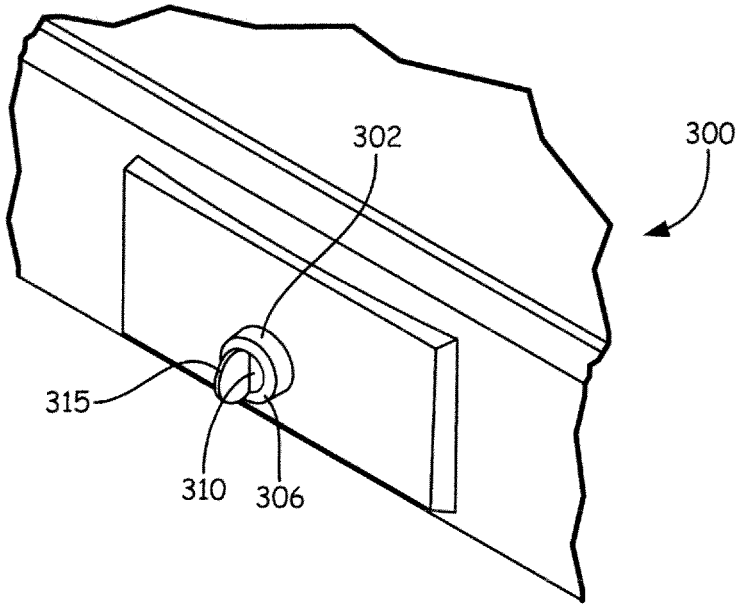
FIGS. 3A-3F illustrate a method for using an emergency access mechanism.

FIGS. 3A-3F illustrate a method for using an emergency access mechanism in accordance with one embodiment. FIG. 3A shows an exemplary emergency access mechanism installed within a flip-top cash drawer 300. In one embodiment, upon installation, a cashier or other user is only able to see the emergency access cover 306 engaged to an emergency access shell 302, with the emergency access plug 304 not readily visible until the cover 306 is removed. In one embodiment, upon needing to access the cash drawer manually, a cashier merely needs to obtain a coin 315 or other suitable flat object.

In one embodiment, the emergency access plug 304 is made of a different colored material than cover 306. When cover 306 breaks, as part of the rotating removal process, the different color of plug 304 indicates to an owner or operator of cash drawer 300 that the emergency access cover 306 has been removed. This may indicate that the cash drawer 300 has been tampered with, or otherwise that broken cover 320 needs to be replaced.

Figure 3B:
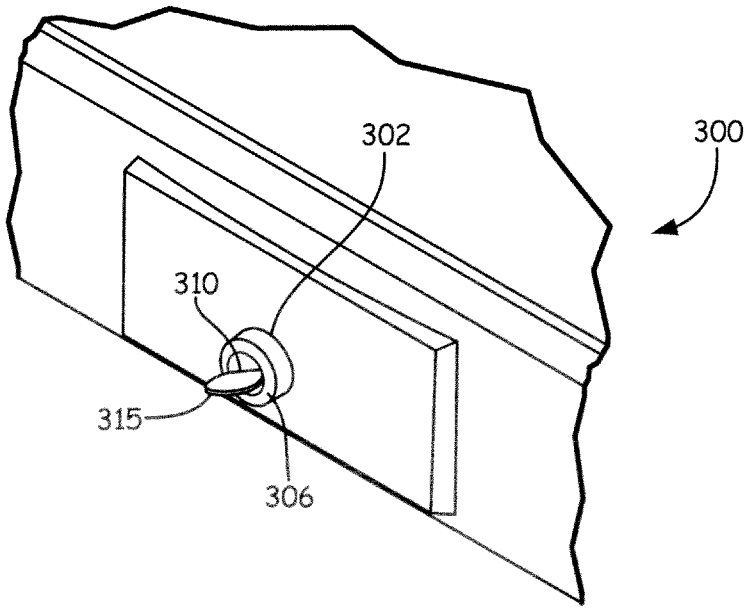
Figure 3C:
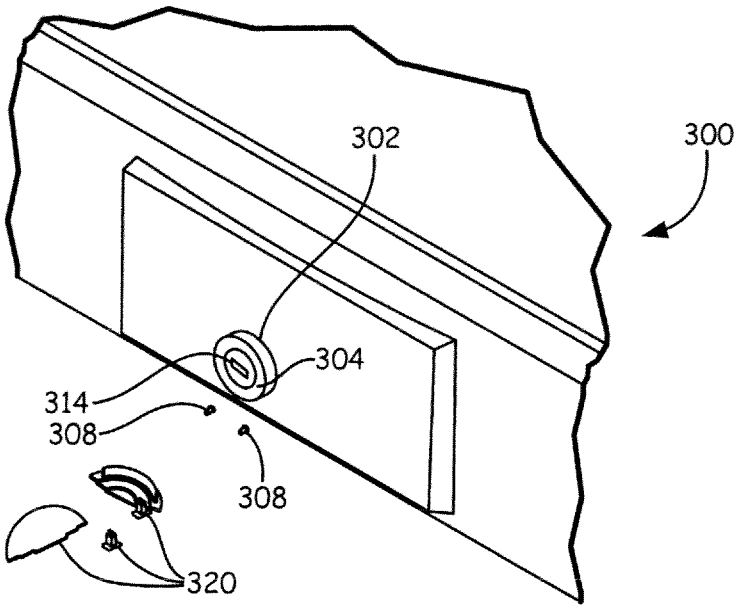

The cashier then inserts the coin 315 or other suitable flat object into the flip-top cash drawer assembly 306 as shown in FIG. 3A. The cashier then actuates, such as by rotation, the coin 315 as shown in FIG. 3B. In one embodiment, rotation of the coin 315 will result in the emergency access cover 306 breaking into several, non-reusable pieces. In one embodiment, as illustrated in FIG. 3C, for example, the cover 306 breaks into a plurality of pieces. In another embodiment, cover 306 does not break, but merely deforms such that it cannot be reused. While actuation is illustrated in FIGS. 3A-F as rotation, the emergency access mechanism could function, in another embodiment, by other actuating means, such as applying a forward force (push) or angled force (e.g. by using the coin 315 as a lever). Other suitable actuation mechanisms may also be used. Further, while FIGS. 3A-F illustrate rotation in a specific direction, either clockwise or counterclockwise motions could be utilized to break the cover 306.

Once the emergency access snaps 308 break, the broken cover 320 can be removed, as shown in FIG. 3C. In one embodiment, the broken cover 320 will fall off of the emergency access mechanism 200 upon the snaps 308 breaking. In another embodiment, the cover 306 may be made of a deformable material such that rotating the coin 315 causes the cover 306 to deform such that pulling the coin 315 away from the emergency access mechanism 200, after breaking snaps 308, results in the cover 306 being removed with the coin 315. FIG. 3C shows the broken cover 320 comprising two portions and an broken access snap 308 separate from the body of the broken cover 320, however, in another embodiment there may be more emergency access snaps 308 present either on the body of the broken cover portions 320, or separate from the broken body, for example, three or four, or fewer emergency access snaps, for example, just one.

Figure 3D:
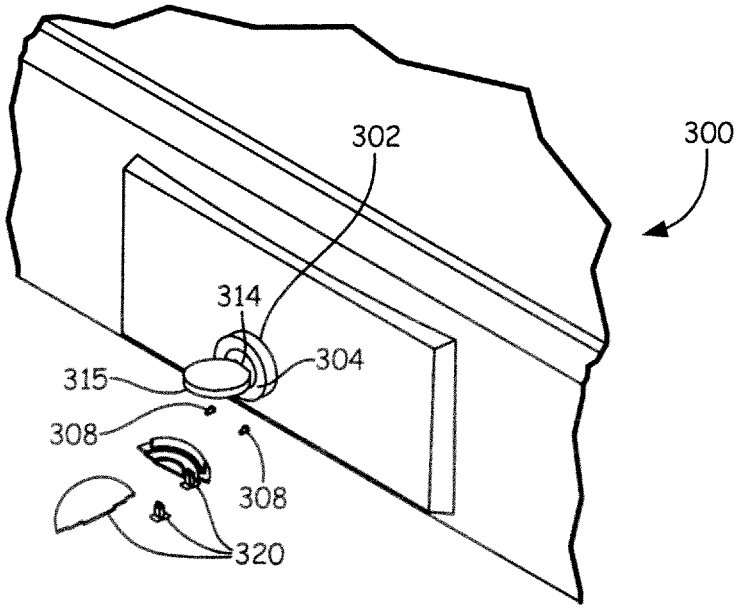
Figure 3E:
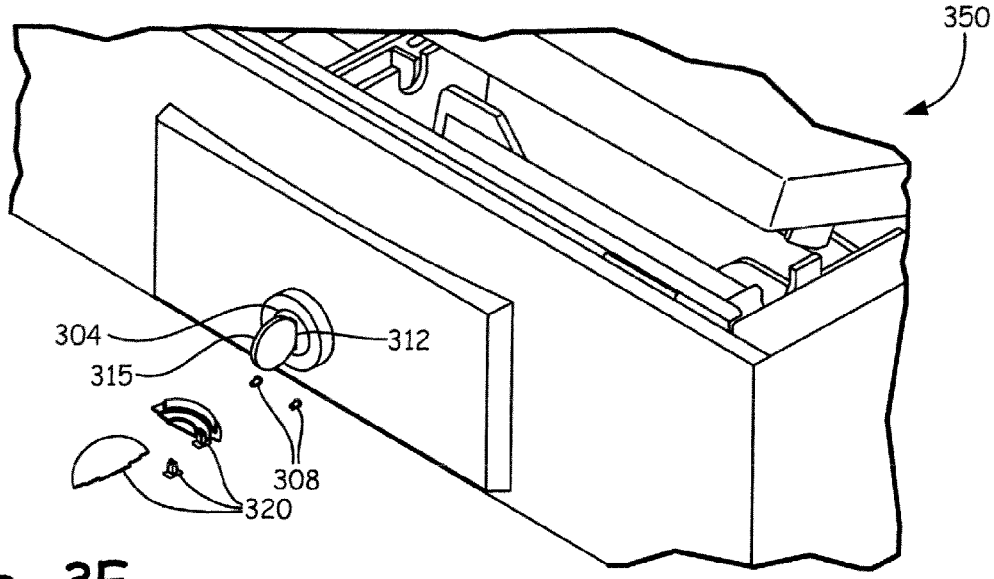
Figure 3F:
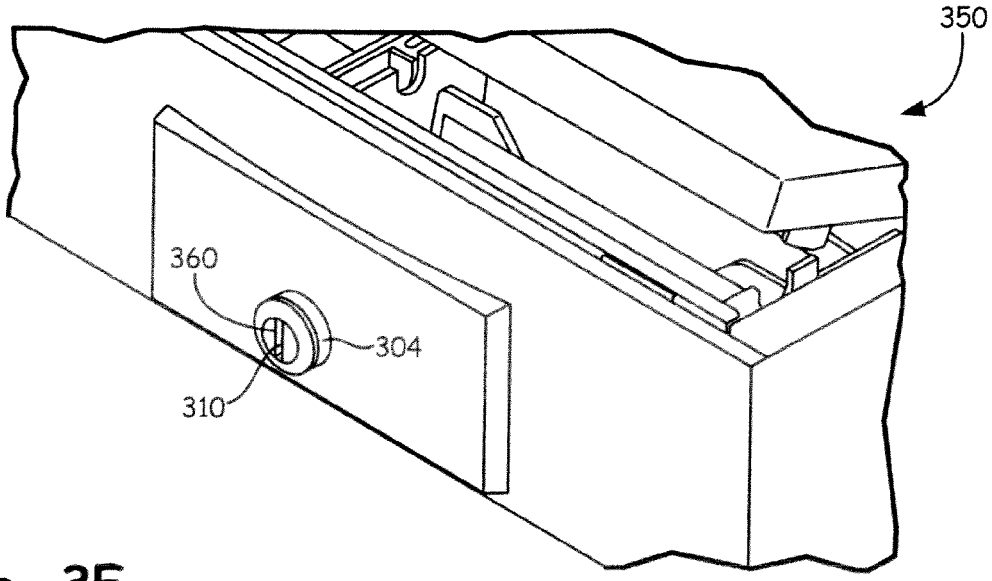

Once the cashier has removed the broken emergency access cover 320 they will then be able to see the emergency access plug 304 as shown in FIGS. 3C and 3D. The cashier then can insert coin 315 into the recess 314 of the emergency access plug 304, triggering the LEM 16. In one embodiment, the cashier may need to rotate the coin 315 as shown in the transition from FIG. 3D to 3E. FIGS. 3D and 3E illustrate a rotation angle of 90°, however in reality the rotation angle may be substantially smaller. For example, in an embodiment where the cover 306 is made of a brittle material, substantially no rotation may occur prior to breaking. However, in an embodiment where the cover 306 is made of a substantially deformable material, significant rotation may be required to reach a breaking point, as shown in FIG. 3E. This results in an open flip-top cash drawer 350. While this method has been shown in FIGS. 3A-3F, utilizing a flip-top cash drawer 300, it is understood by those skilled in the art that the same method and mechanism 300 could be used with the exemplary lay-flat cash drawer 10.

A key feature of the emergency access mechanisms 200 and 300 is the inclusion of a tamper evidence indication. In one embodiment, cover 306 breaks into a plurality of portions when actuated, such that it cannot be replaced over the plug 304. In another embodiment, cover 306 remains substantially intact, and only snaps 308 break off, rendering the cover 306 substantially nonfunctional. The non-functionality of the cover 306 post-access to the cash drawer 300 is that it discourages tampering or theft as such activity is clearly detectable, by way of the tamper evidence indication. In one embodiment, the tamper evidence indication may include the plug 304 being a different color, or different material, than the cover 306 and/or shell 302, providing a visual indicator, visible from a distance, that the cover 306 has been removed. In another embodiment, removal of cover 306 may complete a circuit within the cash drawer 300 such that a visual or audio alert is triggered, for example an LED located within the emergency access mechanism or an alarm system located within the cash drawer 300.

Once the emergency situation has subsided, the emergency access mechanism can be reused with all but the broken emergency access cover 320 remaining functional and in place on the cash drawer 300. An owner of the cash drawer can, in one embodiment, obtain a replacement access cover 360 to put in place of the broken access cover 320. In one embodiment, the replacement access cover 360, with its own set of intact emergency snaps 308, snaps into place over the emergency access plug such that the emergency access mechanism can be put back together without the use of additional tools.

Figure 4:
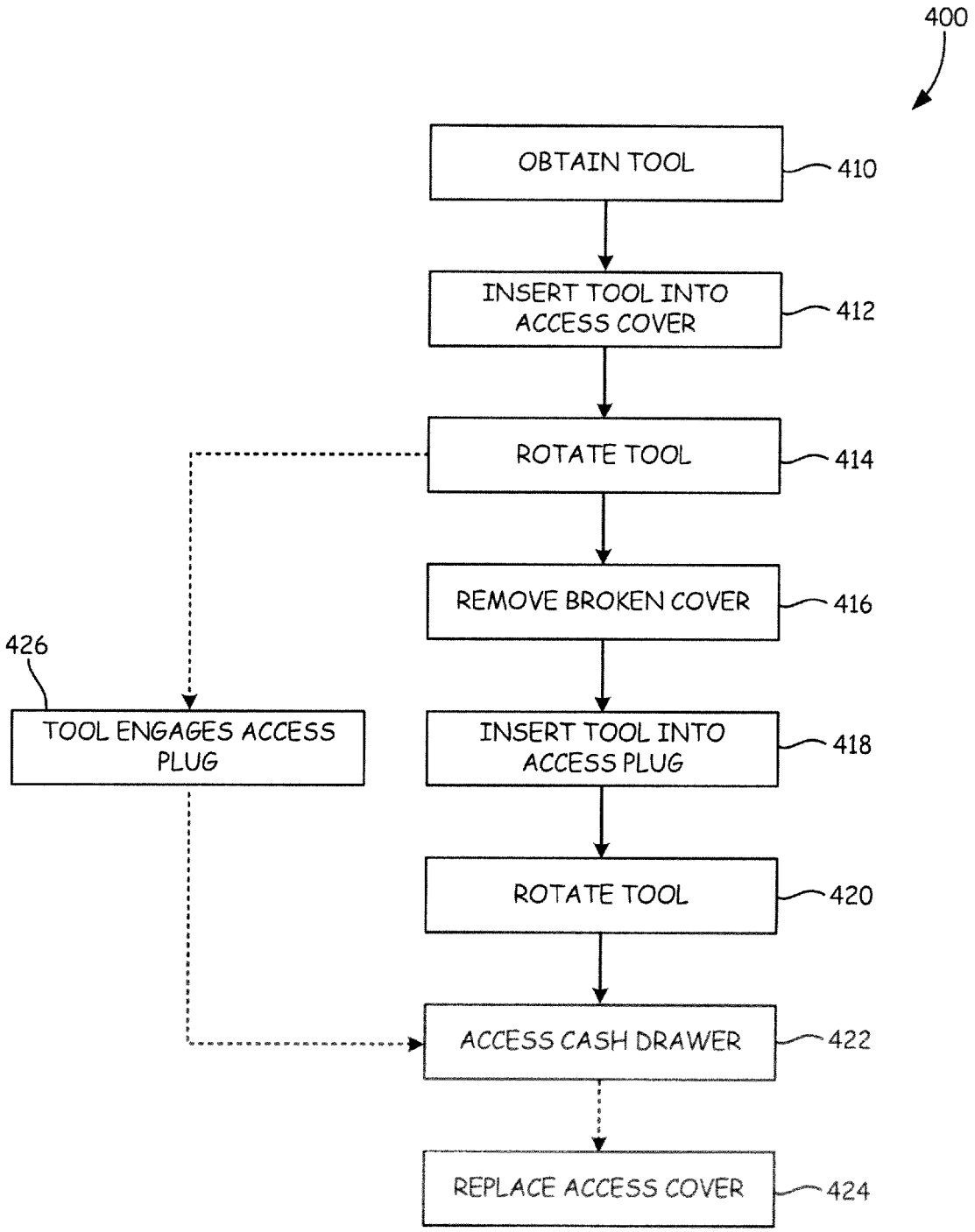
FIG. 4 is a flow diagram illustrating a method for utilizing the emergency access mechanism.

FIG. 4 is a flow diagram illustrating a method for utilizing the emergency access mechanism. Once a cashier or other user of a cash drawer is aware that emergency situation is underway and that access to the cash drawer 300 is necessary, as shown in block 410, the cashier needs to obtain a coin or other object having a flat surface and capable of engaging with recesses 310 and 312. In one embodiment, the recesses 310 and 312 are sized such that a variety of coins 315 can be used, for example, a penny, a one cent euro coin, a nickel, a five cent euro coin, a dime or a ten cent euro coin, or any other substantially regular coin, for example, could be used to rotate the emergency access cover 306 and emergency access plug 304. However, another suitable flat object may also be used, for example a flat head screw driver or other suitable flat object that is configured to fit within the recesses 310 and 312. Once the cashier has obtained a suitable object in block 410, the method 400 then moves to block 412 wherein the cashier inserts the suitable object into the recess 310 of the access cover 306. Once the coin engages recess 310, the cashier rotates the coin as shown in block 414. Once the coin has been sufficiently rotated such that the emergency access snaps 308 break and the cashier may remove the broken cover 320 as shown in block 416.

The cashier is then able, in one embodiment, to see the exposed emergency access plug 304 with recess 312, and may insert the coin into recess 312 as shown in block 418. The cashier may then, in one embodiment, rotate the coin as illustrated in block 420, until the LEM 16 is activated. At this point, if the cashier is using a flip-top cash drawer, the top will open. If the cashier is instead using a lay-flat cash drawer, the drawer will spring forward. The cashier may then access the cash drawer, as shown in block 422. Once the emergency has subsided, the cashier or other owner of the cash drawer then may replace the broken access cover 320 as shown in block 424 with a new cover 306.

In another embodiment, the cashier may be able to insert a coin 315 such that the coin engages both the emergency access cover 306 and the emergency access plug 304. In such an embodiment, after rotating the coin 315 in block 414, the coin, in addition to being engaged with the recess in the access cover 306, also engages with the recess within the access plug 304 such that rotating the coin 315 rotates both the access cover 306 and the access plug 304 as shown in block 426. In this manner the user will still need to rotate the coin such that the emergency access snaps 308 break. However, the user no longer needs to reinsert coin 315 into the emergency access plug 304. Instead, rotating the coin past the breaking point of the snaps 308 also comprises, in one embodiment, sufficient rotation to trigger the LEM. In such an embodiment, the user then is able to access the cash drawer as discussed above with respect to blocks 422 and blocks 424.

In another embodiment, cover 306 is not stationary within the emergency access mechanism in an operable condition, but is rotatable. Rotation may be allowed, for example as snaps 308 are configured to engage the shell 302 such that they move along an inside edge of shell 302 without breaking when rotating. In such an embodiment, slot 310 is located on an outer edge of cover 306 such that a coin 315 or other tool can be inserted into slot 310 and the cover 306 can be removed by an applied leveraging force. In such an embodiment, the cover 306 is deformed or broken and becomes broken cover 320, and must be replaced by replacement cover 360. In such an embodiment, deforming or breaking cover 306 reveals a tamper evidence indicator.

Although the present invention has been described with reference to preferred embodiments, those skilled in the art will recognize the changes as may be made in form and detail without departing from the spirt and scope of the invention.

What is claimed is:

1. An emergency access mechanism comprising:

an emergency access plug configured to engage with a locking mechanism of a cash drawer such that actuation of the emergency access plug causes the locking mechanism to release; and an emergency access cover configured to fit at least partially over and engage an emergency access shell, such that actuation of the emergency access mechanism causes a portion of the emergency access cover to break.

2. The emergency access mechanism of claim 1, wherein actuation of the emergency access mechanism further comprises simultaneous actuation of the emergency access plug.

3. The emergency access mechanism of claim 1, wherein the emergency access cover further comprises a recess configured to receive an actuator.

4. The emergency access mechanism of claim 3, wherein actuation comprises rotation of the emergency access cover.

5. The emergency access mechanism of claim 1, wherein the emergency access cover further comprises at least one snap, wherein the at least one snap is configured to lock the emergency access cover into the emergency access shell, and wherein actuation of the emergency access cover breaks the at least one snap, and wherein the at least one snap is the portion of the emergency access cover that breaks.

6. The emergency access mechanism of claim 1, wherein the emergency access cover breaks once actuated beyond a breaking point.

7. The emergency access mechanism of claim 1, wherein breaking the emergency access cover comprises causing sufficient deformation such that the cover cannot be reused over the emergency access plug.

8. The emergency access mechanism of claim 1, wherein breaking the access cover comprises the access cover breaking into multiple pieces.

9. A method for keyless access to a cash drawer, comprising:

inserting a tool into a fixed cover of an emergency access mechanism that is comprised at least of the fixed cover and a plug;

actuating the tool within the fixed cover within the emergency access mechanism, such that a plurality of snaps fixing the cover to the emergency access mechanism are broken;

removing the fixed cover; and actuating the tool within the plug within the emergency access mechanism, such that the plug engages a locking mechanism of the cash drawer, causing the cash drawer to open.

10. The method of claim 9, wherein the tool comprises a coin and wherein the fixed cover comprises a recess that is configured such that it engages an edge of the coin.

11. The method of claim 9, wherein the cash drawer is a flip top cash drawer.

12. The method of claim 9, wherein the cash drawer is a lay flat cash drawer.

13. The method of claim 9, wherein, upon removal of the fixed cover, a tamper evidence indicator is presented.

14. A system for keyless access to a cash drawer, the system comprising:

an inner drawer with a locking mechanism located within the inner drawer; and an access insert configured to be inserted within the inner drawer such that, once inserted, it can engage the locking mechanism, wherein the access insert further comprises:

an access shell;

an access plug located at least partially within the access shell, wherein actuation of the access plug engages the locking mechanism; and an access cover, wherein the access cover is configured to deform upon actuation past a removal point.

15. The system of claim 14, wherein the access insert is configured to replace a key-access system of a cash drawer.

16. The system of claim 14, wherein the access insert is installed by a manufacturer such that the access shell and access plug are not configured to be removable without visible deformation.

17. The system of claim 14, wherein the access cover further comprises a plurality of breakable snaps that engage with at least the access shell and are configured to break once the access cover moves past the removal point, and wherein the access cover is not removable until the breakable snaps have broken.

18. The system of claim 14, wherein the access cover is made of a deformable material.

19. The system of claim 14, wherein the access plug directly engages the locking mechanism.

20. The system of claim 14, wherein the access shell directly engages the locking mechanism, and wherein actuating the access plug causes the access shell to engage the locking mechanism.

* * * * *